US008523560B2

(12) United States Patent
Anderson et al.

(10) Patent No.: US 8,523,560 B2
(45) Date of Patent: Sep. 3, 2013

(54) SPARK DETECTION IN A FUEL FIRED APPLIANCE

(75) Inventors: Peter Anderson, St. Paul, MN (US); Jonathan McDonald, Bloomington, MN (US); Peter Stolt, Crystal, MN (US); Henry E. Troost, River Falls, WI (US)

(73) Assignee: Honeywell International Inc., Morristown, NJ (US)

( * ) Notice: Subject to any disclaimer, the term of this patent is extended or adjusted under 35 U.S.C. 154(b) by 817 days.

(21) Appl. No.: 12/757,427

(22) Filed: Apr. 9, 2010

(65) Prior Publication Data

US 2011/0247604 A1 Oct. 13, 2011

(51) Int. Cl.
*F23N 5/00* (2006.01)
*G08B 21/00* (2006.01)
*F24C 15/08* (2006.01)

(52) U.S. Cl.
USPC ..... 431/66; 431/71; 431/72; 431/74; 431/24; 340/540; 126/39 BA

(58) Field of Classification Search
USPC ..... 126/39 BA
See application file for complete search history.

(56) References Cited

U.S. PATENT DOCUMENTS 3,574,496 A 4/1971 Hewitt
3,887,325 A 6/1975 Finger et al.
4,033,711 A 7/1977 Christian et al.
4,906,177 A 3/1990 Newberry et al.
5,090,895 A 2/1992 Jensen et al.
5,174,743 A 12/1992 Wellman et al.
5,180,301 A 1/1993 Gross
5,236,328 A 8/1993 Tate et al.
5,261,609 A 11/1993 Roth
5,346,391 A 9/1994 Fullemann et al.
5,368,230 A 11/1994 Oppenberg
5,470,223 A * 11/1995 McCoy ..... 431/24
5,515,297 A 5/1996 Bunting
5,567,143 A 10/1996 Servidio
5,636,981 A 6/1997 Lilly
5,795,462 A 8/1998 Shurtleff
5,899,684 A 5/1999 McCoy et al.
5,921,470 A 7/1999 Kamath
6,004,127 A 12/1999 Heimberg et al.
6,092,738 A 7/2000 Becker (Continued)

OTHER PUBLICATIONS

Beckett Residential Burners, "AF/AFG Oil Burner Manual," 24 pages, Aug. 2009.

(Continued)

*Primary Examiner* — Steven Lim
*Assistant Examiner* — Omeed Alizada
(74) *Attorney, Agent, or Firm* — Seager Tufte & Wickhem LLC.

(57) ABSTRACT

A control system for a fuel-fired appliance and methods of operating are disclosed. In an illustrative embodiment, when an electrical characteristic of an optical detector, such as a resistance, does not change by at least a predetermined amount during an ignition trial, and/or when a level of EMI or electrical noise detected by an antenna in a burner assembly of the fuel-fired appliance does not increase during the ignition trial, the control system may determine that the ignition assembly is not sparking properly. In some instances, the control system may also be programmed to activate an indicator that would indicate to a user or technician a potential problem with the ignition assembly (e.g. not sparking properly to ignite fuel).

22 Claims, 8 Drawing Sheets

(56) References Cited

U.S. PATENT DOCUMENTS

| | | | | |
|---|---|---|---|---|
| 6,099,295 | A | 8/2000 | McCoy et al. | |
| 6,119,954 | A | 9/2000 | Kamath | |
| 6,135,366 | A | 10/2000 | Bodelin et al. | |
| 6,260,773 | B1 | 7/2001 | Kamath | |
| 6,280,180 | B1 * | 8/2001 | Fredin-Garcia-Jurado et al. | 431/27 |
| 6,561,792 | B1 | 5/2003 | Pfund | |
| 6,700,495 | B2 | 3/2004 | Mindermann et al. | |
| 6,829,123 | B2 | 12/2004 | Legatti et al. | |
| 6,953,161 | B2 | 10/2005 | Laursen et al. | |
| 2003/0133236 | A1 * | 7/2003 | Legatti et al. | 361/42 |
| 2006/0084019 | A1 | 4/2006 | Berg et al. | |
| 2007/0143000 | A1 | 6/2007 | Bryant et al. | |
| 2007/0281258 | A1 * | 12/2007 | Clark et al. | 431/74 |
| 2009/0017406 | A1 | 1/2009 | Farias Fuentes et al. | |
| 2011/0247604 | A1 * | 10/2011 | Anderson et al. | 126/39 BA |

OTHER PUBLICATIONS

U.S. Appl. No. 12/757,502, filed Apr. 9, 2010.

U.S. Appl. No. 12/757,543, filed Apr. 9, 2010.

Honeywell, "S9230F1006 2-Stage Hot Surface Ignition Integrated Furnace Controls, Installation Instructions," 20 pages, 2006.

Tradeline, "Oil Controls, Service Handbook," 84 pages, prior to Apr. 9, 2010.

Underwriters Laboratories Inc. (UL), "UL 296, Oil Burners," ISBN 1-55989-627-2, 107 Pages, Jun. 30, 1994.

* cited by examiner

SPARK DETECTION IN A FUEL FIRED APPLIANCE

FIELD

The present disclosure relates generally to fuel fired appliances, and more particularly, to systems and methods for detecting the presence or absence of sparking during ignition trials in a fuel fired appliance.

BACKGROUND

Numerous fuel fired appliances have an igniter for igniting the fuel upon command. Fuel fired appliances include, for example, heating, ventilation, and air conditioning (HVAC) appliances such as furnaces, boilers, water heaters, as well as other HVAC appliances and non-HVAC appliances. Fuel fired appliances typically have a combustion chamber and a burner. A fuel source, such as a gas or oil, is typically provided to the burner through a valve or the like. In many cases, various electrical and/or electromechanical components are provided to help control and/or otherwise carry out the intended function of the fuel fired appliance. For example, various controllers, motors, igniters, blowers, switches, motorized valves, motorized dampers, and/or others, are often included in, or are used to support, a fuel fired appliance.

One particular type of fuel fired appliance is a fuel fired furnace. Fuel fired furnaces are frequently used in homes and office buildings to heat intake air received through return ducts and distribute heated air through warm air supply ducts. Such furnaces typically include a circulation blower or fan that directs cold air from the return ducts across metal surfaces of a heat exchanger to heat the air to an elevated temperature. A burner including an igniter for igniting the fuel is often used to heat the metal surfaces of the heat exchanger. The air heated by the heat exchanger can be discharged into the supply ducts via the circulation blower or fan, which produces a positive airflow within the ducts.

In some instances, the igniter of the burner may fail to produce a spark to ignite the fuel during an ignition trial. If a flame is not detected in the burner during and/or after the ignition trial, the control system may shut down the burner, and in some cases, enter a lockout state. Once in a lockout state, in some cases, a service technician must be called to diagnose and correct the problem before the fuel fired appliance can return to an operational state. Under these circumstances, a significant amount of time may be required for the service technician to diagnose the problem of the igniter failing to spark. Therefore, there is a need for new and improved control systems for detecting the presence or absence of a spark during ignition trials in a fuel-fired appliance.

SUMMARY

The present disclosure relates generally to fuel fired appliances, and more particularly, to systems and methods for detecting the proper operation of a spark igniter during ignition trials in a fuel fired appliance. In one illustrative embodiment, a fuel-fired appliance system is disclosed. The fuel fired appliances may be, for example, a heating, ventilation, and air conditioning (HVAC) appliance such as a furnace, a boiler, a water heater, and/or any other HVAC appliance or non-HVAC appliance. The fuel-fired appliance system may include a controller, as well as an antenna (e.g. antenna element or internal circuitry) and/or an optical detector. The antenna and/or optical detector may be positioned near an igniter of the fuel fired appliance, where the igniter is configured to produce a spark that ignites fuel during an ignition trial when the fuel fired appliance is operating properly.

The controller may be connected to the antenna and/or the optical detector and, in some instances, may be configured to receive a first signal from the antenna and/or a second signal from the optical detector. The controller may determine operation of the igniter when it is activated using the first signal and/or the second signal. For example, in some cases, the controller may monitor the first signal (from the antenna), and determine a relative amount of electromagnetic interference (EMI) or electrical noise adjacent the igniter. If the relative amount of electromagnetic interference (EMI) or electrical noise adjacent the igniter increases, sometimes by at least a predetermined amount, when the ignition assembly is activated, the controller may determine the igniter is fully operational during the ignition trial. If the relative amount of electromagnetic interference (EMI) or electrical noise adjacent the igniter does not increase, sometimes by at least a predetermined amount, when the ignition assembly is activated, the controller may determine the igniter is non-operational during the ignition trial.

Alternatively, or in addition, the controller may monitor an electrical characteristic of the second signal when the igniter is in a deactivated state and when the igniter is in an activated state. The controller may determine that a spark is present during the ignition trial when the electrical characteristic changes, sometimes by more than a predetermined amount, between the activated state and the deactivated state. Likewise, the controller may determine that the spark is absent during the ignition trial when the electrical characteristic does not change, sometimes by more than a predetermined amount, between the activated state and the deactivated state.

The preceding summary is provided to facilitate an understanding of some of the innovative features unique to the present disclosure and is not intended to be a full description. A full appreciation of the disclosure can be gained by taking the entire specification, claims, drawings, and abstract as a whole.

BRIEF DESCRIPTION

The invention may be more completely understood in consideration of the following detailed description of various illustrative embodiments of the disclosure in connection with the accompanying drawings, in which.

DETAILED DESCRIPTION

Figure 1:
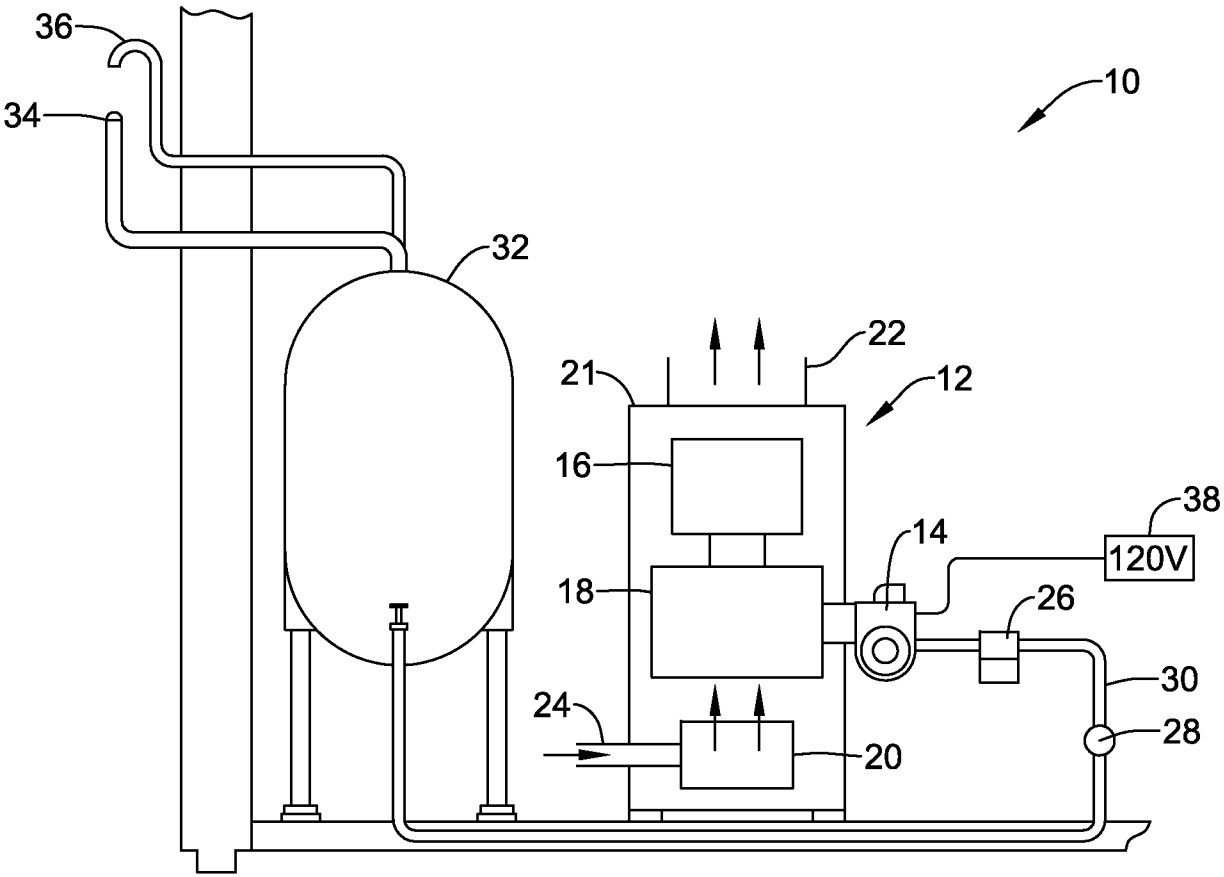
FIG. 1 is a schematic diagram of an illustrative embodiment of an oil-fired HVAC system for a building or other structure.

The following description should be read with reference to the drawings wherein like reference numerals indicate like elements throughout the several views. The detailed description and drawings show several embodiments which are meant to be illustrative of the claimed invention.

For illustrative purposes only, much of the present disclosure has been described with reference to an oil-fired furnace. However, this description is not meant to be so limited, and it is to be understood that the features of the present disclosure may be used in conjunction with any suitable fuel-fired system utilizing a flame detector or flame detection system. For example, it is contemplated that the features of the present disclosure may be incorporated into an oil-fired furnace, an oil-fired water heater, an oil-fired boiler, a gas-fired furnace, a gas-fired boiler, a gas-fired water heater, and/or other suitable fuel-fired system, as desired.

FIG. 1 is a schematic diagram of an illustrative embodiment of an oil-fired HVAC system 10 for a building or other structure. As illustrated, the HVAC system 10 includes a storage tank 32 and an oil fired appliance 12 including a burner 14. Oil can be stored in storage tank 32 and fed to the burner 14 of the fuel fired appliance 12 via a supply line 30. As illustrated, storage tank 32 may include an air vent 36 and a fill line 34 for filling the storage tank 32 with oil, but these are not required. For mere exemplary purposes, the storage tank 32 is illustrated as an above-ground storage tank, but may be implemented as a below ground storage tank or any other suitable oil storage tank, as desired. Alternatively, oil or another fuel may be provided directly to the oil fired appliance 12 via a pipe from a utility or the like, depending on the circumstances.

A valve 28 is shown situated in the supply line 30. The valve 28 can provide and/or regulate the flow of oil from the storage tank 32 (or utility) to the burner 14. In some embodiments, valve 28 may regulate the oil pressure supplied to the burner 14 at specific limits established by the manufacturer and/or by an industry standard. Such a valve 28 can be used, for example, to establish an upper limit to prevent over-combustion within the appliance 12, or to establish a lower limit to prevent combustion when the supply of oil is insufficient to permit proper operation of the appliance 12.

In some cases, a filter 26 may be situated in the supply line 30. The filter 26 may be configured to filter out contaminants and/or other particulate matter from the oil before the oil reaches the burner assembly 14 of the oil-fired appliance 12.

In the illustrative embodiment, the oil-fired appliance, illustratively an oil-fired furnace 12, includes a circulation fan or blower 20, a combustion chamber/primary heat exchanger 18, a secondary heat exchanger 16, and an exhaust system (not shown), each of which can be housed within furnace housing 21. In some cases, the circulation fan 20 can be configured to receive cold air via a cold air return duct 24 (and/or an outside vent) of a building or structure, circulate the cold air upwards through the furnace housing 21 and across the combustion chamber/primary heat exchanger 18 and the secondary heat exchangers 16 to heat the air, and then distribute the heated air through the building or structure via one or more supply air ducts 22. In some cases, circulation fan 20 can include a multi-speed or variable speed fan or blower capable of adjusting the air flow between either a number of discrete airflow positions or variably within a range of airflow positions, as desired. In other cases, the circulation fan 20 may be a single speed blower having an "on" state and an "off" state.

Burner assembly 14 can be configured to heat one or more walls of the combustion chamber/primary heat exchanger 18 and one or more walls of the secondary heat exchanger 16 to heat the cold air circulated through the furnace 12. At times when heating is called for, the burner assembly 14 is configured to ignite the oil supplied to the burner assembly 14 via supply line 30 and valve 28, producing a heated combustion product. The heated combustion product of the burner assembly 14 may pass through the combustion chamber/primary heat exchanger 18 and secondary heat exchanger 16 and then be exhausted to the exterior of the building or structure through an exhaust system (not shown). In some embodiment, an inducer and/or exhaust fan (not shown) may be provided to help establish the flow of the heated combustion product to the exterior of the building.

In the illustrative embodiment, an electrical power source, such as a line voltage supply 38 (e.g. 120 volts, 60 Hz AC), may provide electrical power to at least some of the components of the oil-fired HVAC system 10, such as the oil-fired furnace 12 and/or more specifically the burner assembly 14. The line voltage supply 38 in the United States typically has three lines, L1, neutral, and earth ground, and is often used to power higher power electrical and/or electromechanical components of the oil-fired HVAC system 10, such as circulation fan or blower 20, an ignition system of the burner assembly 14, and/or other higher power components. In some cases, a step down transformer can be provided to step down the incoming line voltage supply 38 to a lower voltage supply that is useful in powering lower voltage electrical and/or electromechanical components if present, such as controllers, motorized valves or dampers, thermostats, and/or other lower voltage components. In one illustrative embodiment, the transformer may have a primary winding connected to terminals L1 and neutral of the line voltage supply 38, and a secondary winding connected to the power input terminals of controller to provide a lower voltage source, such as 24 volt 60 Hz AC voltage, but this is not required.

Although not specifically shown in FIG. 1, it is contemplated that the oil-fired HVAC systems may include other typical HVAC components including, for example, thermostats, sensors, switches, motorized valves, non-motorized valves, motorized dampers, non-motorized dampers, and/or others HVAC components, as desired.

Figure 2:
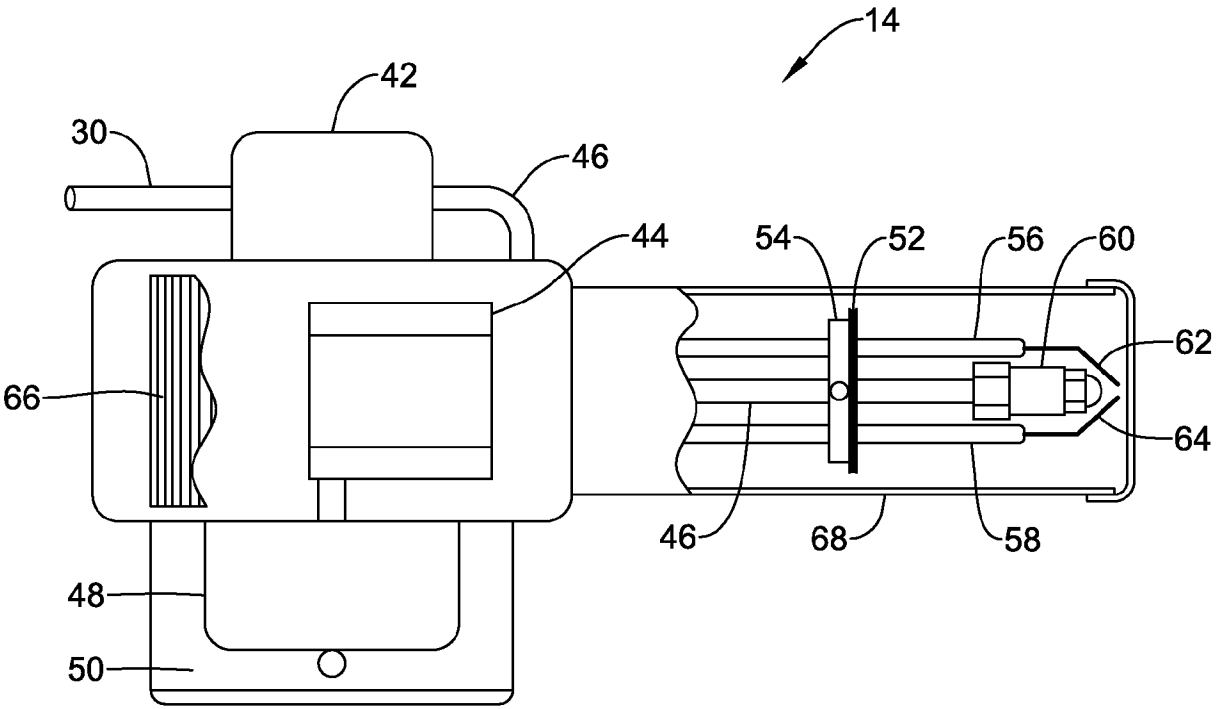
FIG. 2 is a partial cut-away top view of an illustrative oil-fired burner assembly of the HVAC system of FIG. 1.
Figure 3:
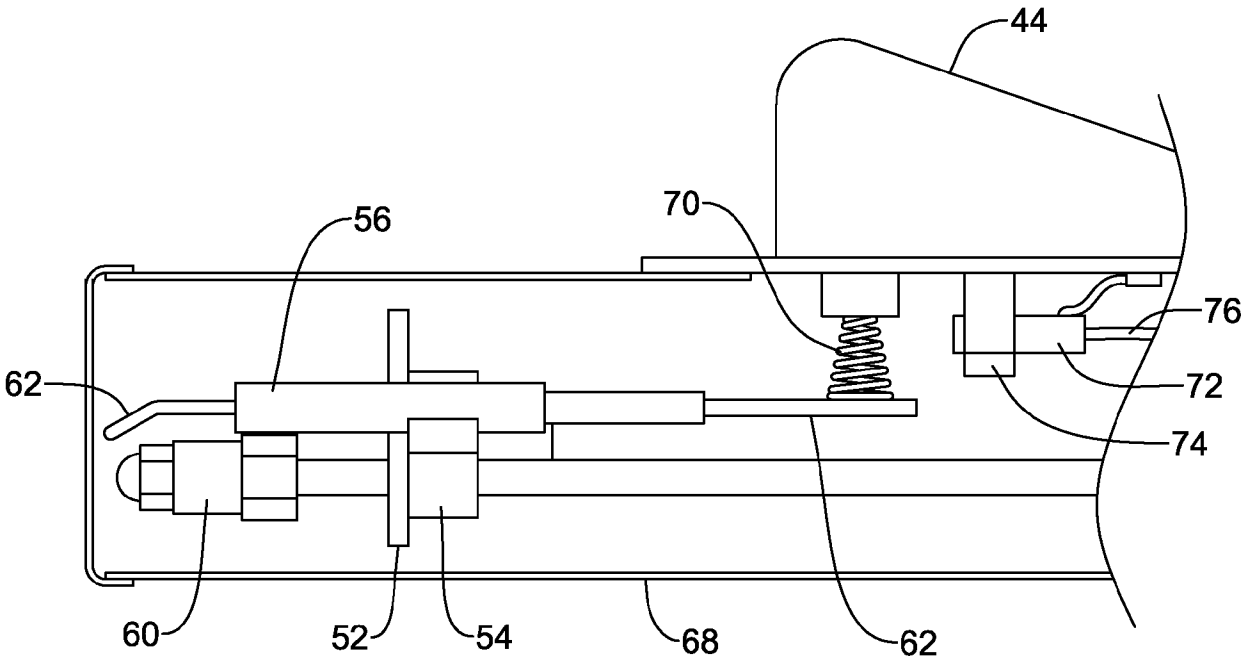
FIG. 3 is a partial cross-sectional view of the illustrative oil-fired burner assembly of FIG. 2.

FIG. 2 is partial cut-away top view and FIG. 3 is a partial cross-sectional view of an illustrative burner assembly 14 of the oil-fired HVAC system 10 of FIG. 1. In the illustrative embodiment, the burner assembly 14 is configured to atomize the oil (i.e. break the oil into small droplets) and mix the atomized oil with air to form a combustible mixture. The combustible mixture is sprayed into the combustion chamber/primary heat exchanger 18 of the oil-fired furnace 12 (shown in FIG. 1) and ignited with a spark from an ignition system of the burner assembly 14.

In the illustrative embodiment, the burner assembly 14 may include a pump 42, a nozzle 60, a motor 50, a blower 66, an air tube 68, an ignition transformer 44, and the ignition system. The pump 42 may have an inlet connected to the oil supply line 30 and an outlet connected to the nozzle 60 via a nozzle line 46. The pump 42 may deliver oil under pressure to the nozzle 60. At the nozzle 60, the oil may be broken into droplets forming a mist that is sprayed into combustion chamber/primary heat exchanger 18. In some situations, the nozzle 60 may break the oil into a relatively fine, cone-shaped mist cloud.

At the same time as the oil mist is being sprayed into the combustion chamber/primary heat exchanger 18, the blower 66, which is driven by motor 50, may be configured to provide an airstream, which in some cases, may be a relatively turbulent airstream, through air tube 68 to mix with the oil mist sprayed into the combustion chamber/primary heat exchanger 18 by the nozzle 60 to form a good combustible mixture. In some cases, a static pressure disc 52 or other restrictor can be positioned in the air tube 68 to create the relatively turbulent airstream or air swirls to mix the airstream and oil mist.

In the illustrative embodiment, the ignition system of the burner assembly 14 may include one or more electrodes, such as electrodes 62 and 64, having one end electrically connected to the ignition transformer 44 and another end extending adjacent to the nozzle 60 and into the oil mist provided by the nozzle 60. When an electrical current is provided to electrodes 62 and/or 64 from the ignition transformer 44, the electrical current may create a "spark" that can ignite the combustible mixture and produce a flame. In some embodiments, the electrodes 62 and 64 may be secured and/or mounted relative to the nozzle 60 in the flow tube 68 with a mounting bracket 54. To electrically insulate the electrodes 62 and 64 from the mounting bracket 54, an insulated material or covering, shown as 56 and 58, may be provided over a portion of the electrodes 62 and 64. As shown in FIG. 3, one end of the electrodes 62 and 64 can be electrically connected to the ignition transformer 44 via one or more springs 70. However, it is contemplated that other suitable connectors may be used to electrically connect electrodes 62 and 64 to ignition transformer 44, as desired.

In the illustrative embodiment, a controller 48 may be included or electrically connected to the burner assembly 14. The controller 48, which may be an oil primary control, may be electrically connected to and/or control the operation of motor 50 for driving blower 66, ignition transformer 44, pump 42, and/or oil valve 28 in response to signals received from one or more thermostats or other controllers (not shown). Although not shown, the controller 48 may be linked to the one or more thermostats and/or other controllers directly (wired or wireless) or via a communications bus (wired or wireless) upon which heat demand calls may be communicated to the furnace 12. The controller 48 may also be used to control various components of the furnace 12 including the speed and/or operation of the circulation fan 20, as well as any airflow dampers (not shown), sensors (not shown), or other suitable component, as desired.

In the illustrative embodiment, the controller 48 may be configured to control the burner assembly 14 between a burner ON cycle and a burner OFF cycle according to one or more heat demand calls received from the thermostat. When a burner ON cycle is called for, the controller 48 may initiate an ignition trial of the burner assembly 14 by providing oil to the burner assembly by actuating valve 28, activating the pump 42 to provide pressurized fuel to nozzle 60, and activating motor 50 to drive blower 66 to provide air for mixing with the oil mist to form a good combustible mixture. The controller 48 may also be configured to selectively energize electrodes 62 and 64 using ignition transformer 44 to ignite the combustible mixture. The energized electrodes 62 and 64 may create a "spark" to ignite the combustible mixture and produce a flame. When a burner OFF cycle is called for, the controller 48 may be configured to actuate valve 28 to cease providing oil to the burner assembly 14 and shut off motor 50 and pump 42.

As shown in FIG. 3, a detector 72 can be provided in or adjacent to the burner assembly 14 in some embodiments. The detector 72 may be configured to detect the presence of a spark and/or a flame during an ignition trial and/or the burner ON cycle. In some cases, the detector 72 may include a light sensitive detector, such as a light sensitive cadmium sulfide (CAD) cell 72. However, it is contemplated that any suitable light detector may be used including, for example, a photodiode or any other suitable light sensitive device. The use of a light sensitive detector may be particularly suited to a burner, such as, for example, an oil-fired burner, that is configured to optically sense the presence or absence of a flame as a single sensor may be used to sense both the flame and the spark. However, it is not required that a single sensor be used to sense both the flame and the spark in the burner and it is contemplated that a separate spark sensing detector and a flame sensing detector may used, if desired.

In the example shown in FIG. 3, the light sensitive CAD cell 72 may be mounted or otherwise secured in the air tube 68 with holder 74 so that it can view the flame when a flame is present and, in some cases, a spark when a spark is present. The CAD cell 72 may be electrically connected to the controller 48 via wires 76 and may send an electrical signal to the controller 48 corresponding to the amount of light detected. For the illustrative CAD cell 72, the resistance of the CAD cell 72 may be light dependent, with the resistance decreasing with more light (e.g. spark or flame present) and increasing with less light (e.g. no spark or flame). In some instances, the CAD cell 72 may be configured to have a "dark" resistance when no spark or flame are present, a "light" resistance when a flame is present, and a resistance between the "dark" resistance and the "light" resistance when a spark is present without a flame. In some cases, the "dark" resistance may be relatively larger than the "light" resistance. For example, the "dark" resistance may be about 20 kilohms, 50 kilohms, 100 kilohms, 500 kilohms, 1 megohm, or any resistances between, for example, 50 kilohms and 1 megohm. The "light" resistance may be any resistance less than the "dark" resistance. Further, it is contemplated that in some implementations, the light detector may be configured such that the "light" resistance may be greater than the "dark" resistance or, in other words, the resistance of the light detector may increase with more light, if desired.

In some embodiments, the CAD cell 72 may "watch" the burner assembly 14 for a spark at startup (i.e. during ignition trial). If the spark is not detected, CAD cell 72 may send an electrical signal to the controller 48 indicating that no spark is present and, in some cases, the controller may shut down the burner assembly 14. In some embodiments, the controller 48 may enter a lockout state to prevent further operation of the burner assembly 14, but this is not required.

Additionally, in some embodiments, the CAD cell 72 may "watch" the burner assembly 14 for a flame at startup and during a burner ON cycle. If the flame fails for any reason, the CAD cell 72 may send an electrical signal to the controller 48 indicating that no flame is present, and the controller may shut down the burner assembly 14. In some embodiments, the controller 48 may enter a lockout state to prevent further operation of the burner assembly 14, but this is not required.

Figure 4:
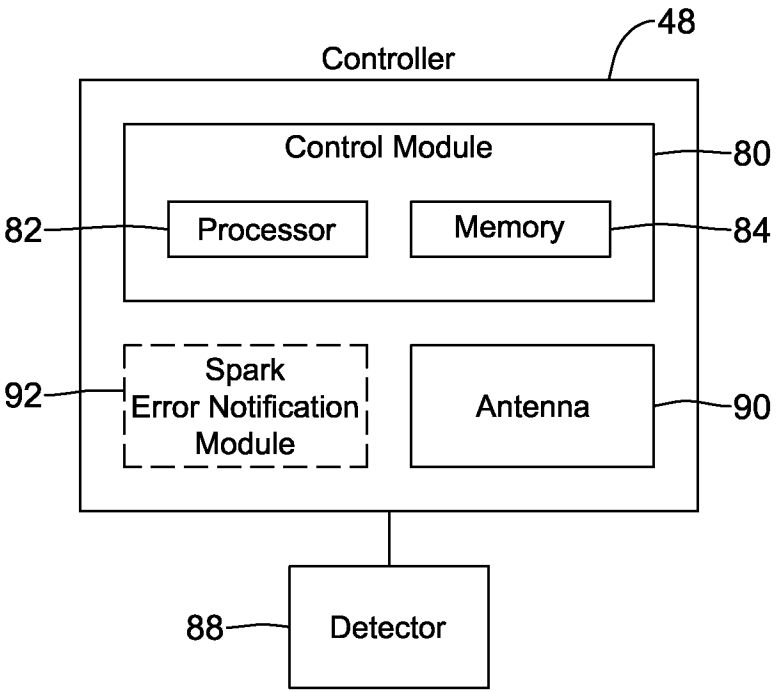
FIG. 4 is a block diagram of an illustrative controller that may be used in conjunction with the oil-fired HVAC system of FIGS. 1-3.

FIG. 4 is a block diagram of an illustrative controller 48 that may be used in conjunction with a fuel-fired system, such as, for example, the oil-fired HVAC system of FIGS. 1-3. It is contemplated that the illustrative controller 48 may be used with any type of fuel-fired appliance, such as gas-fired appliances (e.g. furnace, water heater, boiler, etc.) or oil-fired appliances (e.g. furnace, water heater, boiler, etc.), as desired.

In the illustrative embodiment, the controller 48 includes a control module 80, an antenna 90, and an optional spark error notification module 92. Control module 80 may be configured to control the activation of one or more components of the oil-fired HVAC system 10, such as the burner assembly 14, valve 28, and/or oil-fired furnace 12, in response to signals received from one or more thermostats (not shown) or other controllers. For example, control module 80 may be configured to control the burner assembly 14 between a burner ON cycle and a burner OFF cycle according to the one or more heat demand calls. In some instances, control module 80 may include a processor 82 and a memory 84.

Memory 84 may be configured to store any desired information, such as programming code for implementing the algorithms set forth herein, one or more settings, parameters, schedules, trend logs, setpoints, and/or other information, as desired. Control module 80 may be configured to store information within memory 84 and may subsequently retrieve the stored information. Memory 84 may include any suitable type of memory, such as, for example, random-access memory (RAM), read-only member (ROM), electrically erasable programmable read-only memory (EEPROM), Flash memory, and/or any other suitable memory, as desired.

A detector 88 may be coupled to or in electrical communication with the control module 80. In some cases, the detector 88 may be a light sensitive detector, including for example, a CAD cell, such as CAD cell 72 shown in FIG. 3, a photodiode, and/or other suitable optical detection device or system capable of detecting the presence or absence of a spark, as desired. The detector 88 may be configured to provide an electrical signal to the control module 80 having an electrical characteristic (e.g. resistance, current, voltage, etc.) indicating the presence or absence of a spark during an ignition trial. For example, in the illustrative embodiment of the detector 88 including CAD cell 72, as discussed above, the resistance of CAD cell 72 may be light sensitive, and may vary according to the presence or absence of light. In some cases, the resistance of the CAD cell 72 may decrease with more light (e.g. spark and/or flame present). For example, the CAD cell 72 may have a "dark" resistance in the range of 50 kilohms to 1 megohm and a "light" resistance that is less than the "dark" resistance. If the spark is not detected during startup, the control module 80 may receive a signal from the detector 88 indicating that no spark is detected and, in some embodiments, the control module 80 may shut down the burner assembly 14 and/or valve 28.

In some embodiments, a threshold level may be stored in memory 84 of the control module 80. The threshold level may be a level at which, under normal operating conditions, the electrical characteristic (e.g. resistance, current, voltage, etc.) of the flame detector 88 is expected to change by an amount that reliably indicates a spark is present. When the electrical characteristic of the signal received from the flame detector 88 changes by more than the threshold level during an ignition trial, the control module 80 may determine that a spark was successfully produced by the ignition assembly (e.g. electrodes 62 and 64). When the electrical characteristic of the signal received from the flame detector 88 does not change or changes less than the threshold level during an ignition trial, the control module 80 may determine that a spark was not successfully produced by the ignition assembly (e.g. electrodes 62 and 64). In the example case of a CAD cell 72, the control module 80 may determine that the ignition assembly produced a spark when the CAD cell 72 has a resistance that decreases by the threshold level, and did not produce a spark when the CAD cell 72 has a resistance that did not decrease by the threshold level. In some cases, the threshold level may be a percentage based level, such as, for example, a 5 percent change, a 6 percent change, a 7.5 percent change, a 10 percent change, a 15 percent change, or any suitable percentage change, as desired. In other embodiments, the threshold change level may be a predetermined change in the electrical characteristic of the detector 88, such as, for example, 5 ohms, 10 ohms, 20 ohms, 50 ohms, or any other resistance or electrical characteristic, as desired. It is further contemplated that, in some embodiments, the threshold may be a learned value based on past history of igniting the burner. For example, if it is determined that a signal received from the detector 88 routinely shifts or changes by a relatively consistent amount, such as 10 percent, on successful ignition attempts, the threshold level may be set at that amount, for example, 10 percent change. In some embodiments, as the burner ages and characteristics of the burner change (due to wear out, soot build up, etc.), the threshold level may be adjusted (e.g. increased or decreased) to maintain reliable performance of the burner. At some point it may be determined that the detector 88 is no longer capable of sensing spark. In this case the control module 80 may activate an alarm indicating that the detector 88 cannot sense spark and/or the control module 80 may abort the optical manner of sensing the spark.

Antenna 90 may also be configured to detect operation of the igniter during an ignition trial of the fuel-fired appliance. While the antenna 90 is shown as part of the controller 48, it is contemplated that the antenna 90 could be located remotely from the controller 90 but in communication with the controller 90. In some cases, the antenna 90 may detect electromagnetic interference (EMI) or electrical noise produced by the ignition assembly when it is operational (e.g. spark is present and/or current passing through electrodes). In some instances, the control module 80 is electrically connected to the antenna 90 to receive the detected signal from the antenna 90. The control module 80 may be configured to determine operation of the ignition assembly during an ignition trial. In some embodiments, the antenna 90 can include one or more antenna elements and/or internal circuitry, such as a metal trace on a printed circuit board, acting as an antenna. However, it is contemplated that antenna 90 may be any suitable antenna that may detect EMI or electrical noise produced by the ignition assembly. If igniter operation is not detected during an ignition trial, the control module 80 may receive a signal from the antenna 90 indicating that no spark is present and, in some embodiments, the control module 80 may shut down the burner assembly 14 and/or valve 28.

In some embodiments, the control module 80 may be configured to optically (using detector 88) and electrically (using antenna 90) detect operation of the ignition assembly. In other words, the control module 80 may be configured to utilize both the detector 88 and the antenna 90 in an attempt to detect the operation of the ignition module during an ignition trial. In some cases, this may provide for redundant detection, which in some cases, can be more accurate, more reliable, and more versatile. The control module 80 may be configured to determine the ignition module is non-operational when, for example, both the detector 88 and the antenna 90 indicate the ignition module is non-operational, or, in other cases, the control module may determine the ignition module is non-operational when either of the detector 88 or the antenna indicates the ignition module is non-operational.

Further, it is contemplated that the control module 80 may be configured to utilize only one of the detector 88 and the antenna 90 to detect operation of the ignition module, depending on the determined reliability of the detector 88 and antenna 90 for the specific installation. For example, if the ignition assembly or electrodes 62 and 64 are shielded in a particular installation, so that a sufficient amount of EMI or electrical noise may not be picked-up by the antenna, the control module 80 may be configured to operate using the detector 88 to optically detect the presence or absence of a spark. In other cases, if the detector 88, such as CAD cell 72, is not properly optically aligned with the spark, the control module 80 may operate using the antenna 90 to detect operation of the ignition module. In these situations, the control module 80 may be configured to determine the reliability of the detector 88 and antenna 90 for detecting operation of the ignition module, and may subsequently operate with the more reliable of the antenna 90 and detector 88. In other cases, the control module 80 may operate using both the detector 88 and antenna 90, such as described above.

Further, it is contemplated that in any of the embodiments mentioned previously, the control module 80 may be configured automatically select the more reliable of the detector 88 and antenna 90 for detecting operation of the ignition module, but this is not required. The control module 80 may determine, for example, that a particular component (e.g. detector 88 or antenna 90) is capable of detecting operation of the ignition module while the other component (e.g. detector 88 or antenna 90) is not capable of detecting operation of the ignition module. In some cases, this may be based, at least in part, on past performance of the burner. For example, if the burner repeatedly lights with the detector 88 indicating a spark is present and the antenna 90 indicating the ignition module is non-operational, the control module 80 may determine the detector 88 is reliable and the antenna 90 is unreliable. Similarly, if the burner repeatedly lights with the antenna 90 indicating operation of the ignition module and the detector 88 indicating that the spark is absent, the control module 80 may determine the antenna 90 is reliable and the detector 88 is unreliable. In other cases, the controller module 80 may determine that the detector 88 and/or antenna 90 is unreliable if a signal received from the detector 88 and/or antenna 90 indicates the ignition module is operational all the time. In any of these situations, the control module 80 may be configured to disregard the unreliable component, if desired. In some embodiments, the control module 80 may also issue an alarm (visual or audible) indicating that the detector 88 and/or antenna 90 is unreliable in determining operation of the ignition module.

In some embodiments, an optional spark error notification module 92 may be provided. The optional spark error notification module 92 may be configured to issue a notification or other indication to an operator or service technician if the control module 80 determines that the igniter is not operational during ignition trial. In some embodiments, the spark error notification module 92 may include an audible notification and/or a visual notification. Examples of audible notifications may include, for example, an alarm, siren, audible message, and/or other audible notification, as desired. Examples of visual notifications may include, for example, a flashing light, a constant light, a textual message displayed on a display or sent via email, and/or other visual notification, as desired. The spark error notification module 92 may alert an operator or service technician that the igniter is not providing sufficient sparking to ignite the combustible fuel during the ignition trial.

Although not shown in FIG. 4, it is contemplated that the controller 48 may include a user interface that is configured to display and/or solicit information as well as permit a user to enter data and/or other settings, as desired. In some instances, the user interface may include a touch screen, a liquid crystal display (LCD) panel and keypad, a dot matrix display, a computer, buttons and/or any other suitable interface, as desired.

Figure 5:
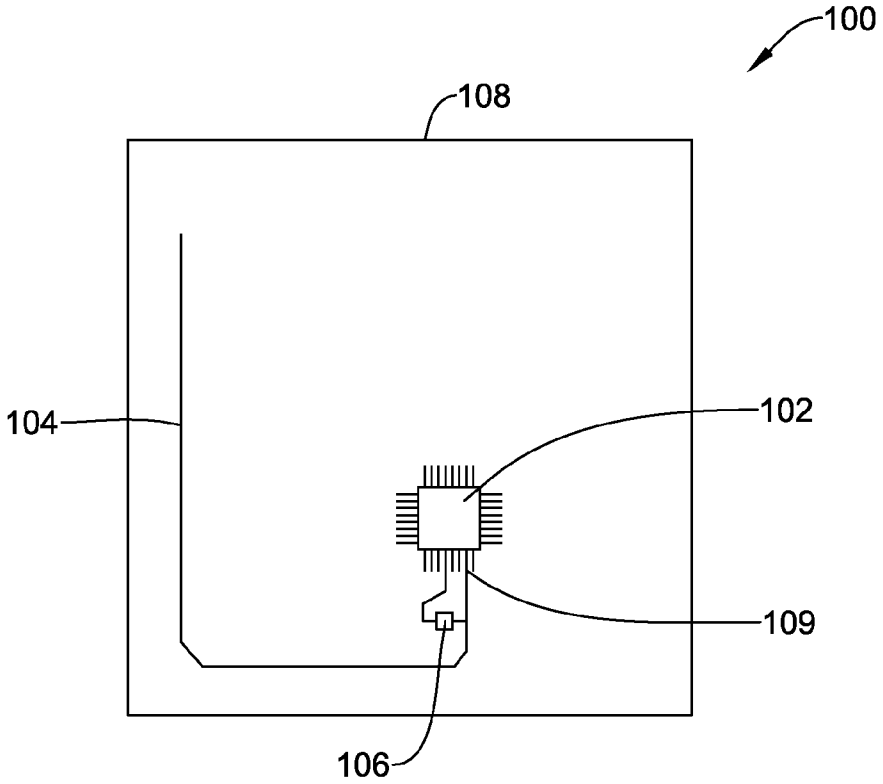
FIG. 5 is a schematic diagram of an illustrative antenna that may be used with the controller of FIG. 4.

FIG. 5 is a schematic diagram of an illustrative controller 100 including an illustrative antenna 104. In some embodiment, antenna 104 may be used in conjunction with the controller 48 shown in FIG. 4. As shown in FIG. 5, the controller 100 may include a microcontroller 102 mounted on a printed circuit board (PCB) 108. In some cases, the microcontroller 102 may be implemented as the control module 80 shown in FIG. 4, if desired. As illustrated in FIG. 5, the antenna 104, which can be a metal trace 104 on the PCB 108, may be electrically connected to a pin 109 of the microcontroller 102. In some cases, the antenna 104 may be configured to provide a logic level low (e.g. logic 0) or a logic level high (e.g. logic 1) input to the microcontroller 102. In the illustrative embodiments, the antenna 104 is biased to a ground pin of the microcontroller 102 via a resistor 106. In such a configuration, the antenna 104 may be biased to provide a logic low level input to the microcontroller 102 when no EMI or electrical noise is detected. However, it is contemplated that the antenna 104 may be biased to a logic high level, such as to a supply voltage of the microcontroller 102, if desired. In the illustrative embodiment, resistor 106 may have a relatively large resistance, such as 1 megaohm. However, this is just one example and it is contemplated that any suitable resistance, or even none at all may be used, as desired.

In the illustrative embodiment, EMI or electrical noise produced operation of the ignition module in the burner assembly can produce one or more interrupts in the normal logic level low signal of the antenna 104. The microcontroller 102 may be configured to determine operation of the ignition module by determining the number of interrupts per unit of time when the ignition assembly should be sparking (e.g. activated state) and when the ignition assembly should not be sparking (e.g. deactivated state). Since a spark should generally create an increased level of EMI or electrical noise, there should be more interrupts per unit of time when the igniter is properly operating. If, however, the igniter is not properly operating, the number of interrupts per unit of time detected by the microcontroller 102 may not increase or be sufficiently high.

Figure 6:
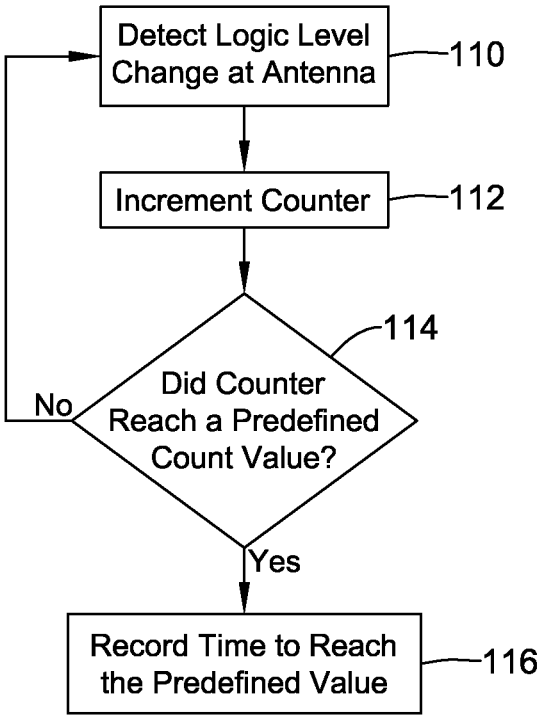
FIG. 6 is a flow diagram of an illustrative method of detecting electromagnetic noise emitted by a spark using an illustrative antenna.

FIG. 6 is a flow diagram of an illustrative method of detecting the amount of EMI or electrical noise emitted by a spark with a controller 48 having an antenna, such as antenna 90 and antenna 104. The illustrative method may be employed by controller 48 shown in FIG. 4, if desired. As shown in block 110, the controller 48 may detect a logic level change in the signal received from the antenna 90 and 104. In block 112, when a logic level change has been detected (e.g. the voltage crosses a threshold voltage level), the controller 48 may increment a counter.

In decision block 114, the controller 48 may determine if the counter reached a predefined count value. If the counter has not reached the predefined count value, then the controller 48 may return to block 110 and wait for the next logic level change in the signal received from the antenna. If the counter has reached the predefined count value, then in block 116, the controller 48 may record the amount of time that was needed to reach the predefined count value. If the amount of time that was needed to reach the predefined count value was relatively small, then there may be a relatively high amount of EMI or electrical noise, which may indicate operation of the ignition module. If the amount of time needed to reach the predefined count value was relatively large, then there may be a relatively low amount of EMI or electrical noise, which may indicate the ignition module is not operating.

Figure 7:
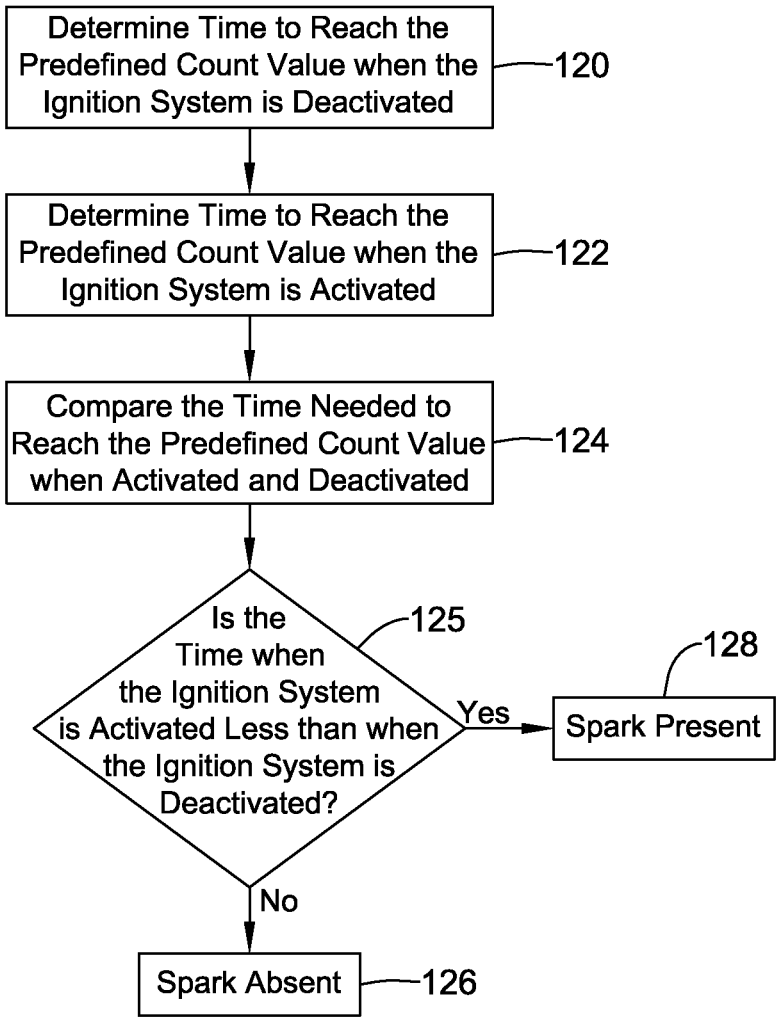
FIG. 7 is a flow diagram of an illustrative method of determining if a spark is present or absent during an ignition trial using an illustrative antenna.

FIG. 7 is a flow diagram of an illustrative method of detecting the presence or absence of a spark during an ignition trial using an illustrative antenna, such as antenna 90 and antenna 104. The illustrative method may be employed by controller 48 shown in FIG. 4, if desired. As shown in block 120, the controller 48 may determine the time needed to reach the predefined count value when the igniter is deactivated (e.g. not sparking). In some cases, this may be determined using the illustrative method of FIG. 6. However, it is contemplated that the controller 48 may instead use a different method to determine the number of interrupts per unit of time, if desired.

Then, as shown block 122, the controller 48 may determine the time needed to reach the predefined count value when the igniter is activated (e.g. should be sparking). In some cases, this may be determined using the illustrative method of FIG. 6. However, it is contemplated that the controller 48 may instead use a different method to determine the number of interrupts per unit of time, if desired.

In block 124, the controller 48 may compare the time needed to reach the predefined count value when the igniter is activated and to the time needed when the igniter is deactivated. In decision block 125, the controller may determine if the time needed when the igniter is activated is less than the time needed when the counter is deactivated. If the time needed when the ignition system is activated is less than when the ignition system is deactivated, in block 128, the ignition module may be determined to be operational during the ignition trial. If the time needed when the ignition system is activated is not less than when the ignition system is deactivated, in block 126, the ignition module may be determined to be non-operational during the ignition trial. Although not shown in FIG. 7, in some embodiments the controller 48 may issue a spark error notification when the spark is absent, but this is not required.

Figure 8:
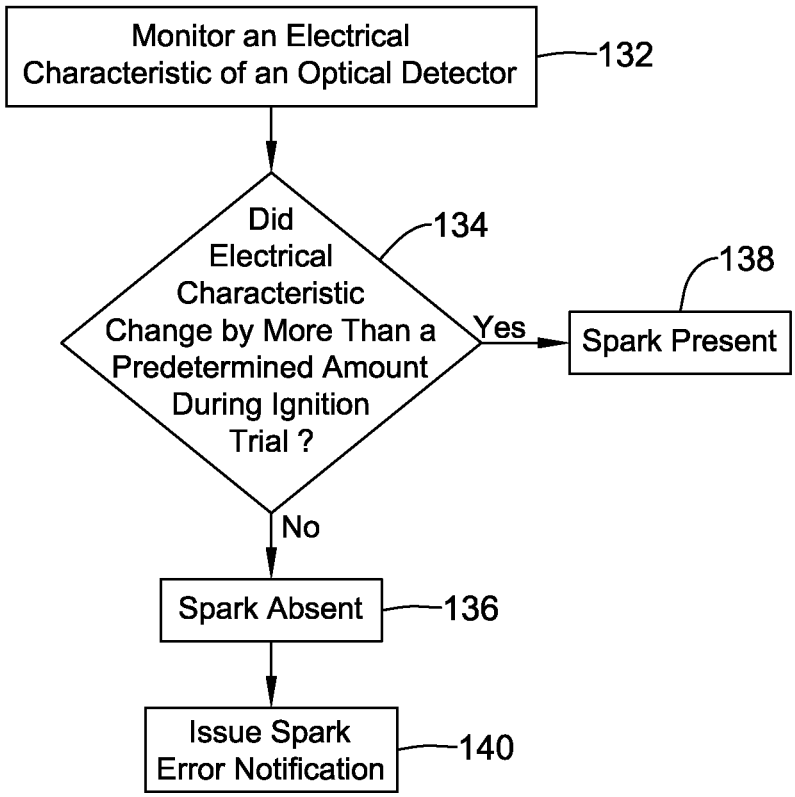
FIG. 8 is a flow diagram of an illustrative method of determining if a spark is present or absent during an ignition trial using a detector.

FIG. 8 is a flow diagram of an illustrative method of determining if a spark is present or absent during an ignition trial using a detector 88. The illustrative method may be employed by the controller 48 shown in FIG. 4, if desired. As shown in block 132, the controller 48 may monitor an electrical characteristic (e.g. resistance, current, voltage, etc.) of a detector 88 (e.g. CAD cell, etc.). For example, the controller 48 may monitor the electrical characteristic before, during, and/or after one or more ignition trials. In some cases, the controller 48 may track the electrical characteristic of the detector 88 and/or changes in the electrical characteristic of the detector 88 and store them in memory 84.

In decision block 134, the controller 48 may determine if the electrical characteristic of the detector 88 changed by more than a predetermined amount during an ignition trial. In some cases, the predetermined amount may be determined according to a percentage of the electrical characteristic or, in other cases, may be a change in value. Example changes in percentages may be 5 percent, 6 percent, 7.5 percent, 10 percent, 15 percent, 25 percent, 40 percent and/or other percentages, as desired. If the electrical characteristic of the detector 88 is resistance, the predetermined amount may be 5 ohms, 10 ohms, 20 ohms, 50 ohms, 100 ohms, 200 ohms, 1 kilohms, 5 kilohms, 10 kilohms, 15 kilohms, 20 kilohms, 25 kilohms, 40 kilohms, 50 kilohms, or any other change in resistance, as desired.

If the electrical resistance of the detector 88 was determined to have changed by more than a predetermined amount in decision block 134, then in block 138, the controller 48 may determine that a spark is present during the ignition trial. If the electrical characteristic of the detector 88 did not change by more than a predetermined amount, then, as in block 136, the controller 48 may determine that a spark was absent during the ignition trial. In some embodiments, as shown in block 140, the controller 48 may then issue a spark error notification indicating that the ignition assembly is not providing sufficient sparking.

In some instances, the predetermined amount can be updated or change over time. For example, if it is determined that the predetermined amount that the electrical characteristic of the detector changes in response to a detected spark begins to reduce over time, the controller may adjust the predetermined amount accordingly. Limits may be placed on the amount of adjustment. Under some circumstances, this may help reduce the number of false alarms and/or false lockouts within a fuel fired appliance.

Having thus described the preferred embodiments of the present invention, those of skill in the art will readily appreciate that yet other embodiments may be made and used within the scope of the claims hereto attached.

What is claimed is:

1. A fuel-fired appliance comprising:

a burner assembly including an igniter that is configured to selectively ignite a fuel received from a fuel supply with a spark when the igniter is activated;

an optical detector capable of optically detecting the presence or absence of the spark; and a controller connected to the burner assembly and the optical detector, wherein the controller is configured to selectively control the operation of the burner assembly;

wherein the controller is further configured to receive a signal from the optical detector, the controller being programmed to monitor an electrical characteristic of the signal when the igniter is in a deactivated state and when the igniter is in an activated state, wherein the controller is configured to determine that a spark was not successfully produced by the igniter when the electrical characteristic of the signal changes by less than a threshold amount, and the controller is configured to determine that a spark was successfully produced by the igniter when the electrical characteristic of the signal changes by more than the threshold amount.

2. The fuel-fired appliance of claim 1, wherein the electrical characteristic is a resistance.

3. The fuel-fired appliance of claim 1, wherein the optical detector is a cadmium sulfide (CAD) cell.

4. The fuel-fired appliance of claim 1, further comprising an indicator for indicating to an operator that a spark was not successfully produced by the igniter.

5. The fuel-fired appliance of claim 1, further comprising an alarm, wherein the controller is configured to activate the alarm when it is determined that the signal is unreliable in determining that a spark was successfully produced.

6. A fuel-fired appliance comprising:

a burner assembly including an igniter that is configured to selectively ignite a fuel received from a fuel supply with a spark when the igniter is activated;

an antenna configured to receive electromagnetic interference (EMI) or electrical noise emitted by the igniter;

a controller connected to the burner assembly and the antenna, wherein the controller is configured to selectively control the operation of the burner assembly; and wherein the controller is further configured to receive a signal from the antenna, the controller being programmed such that an interrupt is generated in the controller each time the signal from the antenna indicates that the electromagnetic interference (EMI) or electrical noise emitted by the igniter meets predetermined first criteria, and wherein the controller is configured to determine that a spark was successfully produced by the igniter when the number of interrupts per unit time meets predetermined second criteria.

7. The fuel-fired appliance of claim 6, wherein the predetermined first criteria includes the signal from the antenna exceeding a first threshold, and wherein the predetermined second criteria includes the number of interrupts per unit time exceeding a second threshold.

8. The fuel-fired appliance of claim 6, wherein the controller is programmed to determine the number of interrupts per unit time by counting interrupts when the igniter is activated and determining a first amount of time needed for the number of interrupts to reach a predefined number of interrupts.

9. The fuel-fired appliance of claim 8, wherein the controller is further configured to determine a number of interrupts per unit time when the igniter is not activated.

10. The fuel-fired appliance of claim 9, wherein the controller is configured to determine if the number of interrupts per unit of time when the igniter is activated is greater than the number of interrupts per unit of time when the igniter is deactivated, and if so, determining that the predetermined second criteria to be met.

11. The fuel-fired appliance of claim 6, wherein the antenna is a metal trace on a printed circuit board of the controller.

12. The fuel-fired appliance of claim 6, further comprising an indicator for indicating to an operator when the controller determines that a spark was not successfully produced by the igniter while the igniter is activated.

13. A fuel-fired appliance comprising:

a burner assembly including an igniter that is configured to selectively ignite a fuel received from a fuel supply with a spark when the igniter is activated;

an antenna configured to receive electromagnetic interference (EMI) or electrical noise emitted by the igniter;

an optical detector capable of optically detecting the presence or absence of the spark;

a controller connected to the burner assembly, the antenna, and the optical detector, wherein the controller is configured to selectively control the operation of the burner assembly; and wherein the controller is further configured to receive a first signal from the antenna and a second signal from the optical detector, the controller is programmed to use the first signal and/or the second signal to determine an operational state of the igniter when the igniter is activated.

14. The fuel-fired appliance of claim 13, wherein the controller determines the presence or absence of the spark when the igniter is activate using the second signal by detecting if an electrical characteristic of the second signal changes by more than a predefined amount during at least a portion of the ignition attempt.

15. The fuel-fired appliance of claim 14, wherein the controller is configured to determine that the spark is present when the electrical characteristic changes by more than the predefined amount during at least a portion of the ignition attempt, and the controller is configured to determine that the spark is absent when the electrical characteristic fails to change by more than the predefined amount during at least a portion of the ignition attempt.

16. The fuel-fired appliance of claim 15, wherein the electrical characteristic is a resistance.

17. The fuel-fired appliance of claim 13, wherein the controller counts a number of times that the first signal changes logic levels per a unit of time when the igniter is in a deactivated state, and a number of times that the first signal changes logic levels per unit of time when the igniter is in an activated state, and wherein the controller determines that the igniter is operational when the number of times that the first signal changes logic levels per unit of time is greater in the activated state than in the deactivated state, and the controller determines that the igniter is non-operational when the number of times that the first signal changes logic levels per unit of time is not greater in the activated state than in the deactivated state.

18. The fuel-fired appliance of claim 13, further comprising an indicator for indicating to an operator that non-operation of the igniter has been determined while the igniter is activated.

19. The fuel-fired appliance of claim 13, wherein the controller is configured to determine if the first signal or the second signal more reliably detects the operational state of the igniter, and the controller is further configured to subsequently operate using only the more reliable of the first signal or the second signal to determine the operational state of the igniter.

20. The fuel-fired appliance of claim 13, further comprising an alarm, wherein the controller is configured to activate the alarm when it is determined that the first signal and/or the second signal is unreliable in determining the operational state of the igniter.

21. The fuel-fired appliance of claim 20, wherein the controller is configured to disregard the first signal if the first signal is determined to be unreliable in determining the operational state of the igniter, wherein the controller is configured to disregard the second signal if the second signal is determined to be unreliable in determining the operational state of the igniter.

22. The fuel-fired appliance of claim 13, wherein the first signal or the second signal is determined to be unreliable when the first signal or the second signal indicates that the igniter is non-operational and the fuel ignites, and/or the first signal or the second signal indicates that the igniter is operational all the time.

* * * * *